US006402644B2

(12) United States Patent
Stanford et al.

(10) Patent No.: US 6,402,644 B2
(45) **Date of Patent: *Jun. 11, 2002**

(54) CONSTANT FORCE ADJUSTABLE BASKETBALL GOAL ASSEMBLY

(75) Inventors: Carl R. Stanford, Clinton; Charles Monsen, Brigham City, both of UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/840,534

(22) Filed: Apr. 23, 2001

Related U.S. Application Data

(63) Continuation-in-part of application No. 09/694,620, filed on Oct. 23, 2000, which is a continuation-in-part of application No. 09/249,278, filed on Feb. 11, 1999, now Pat. No. 6,135,901, which is a continuation-in-part of application No. 09/018,231, filed on Feb. 3, 1998, now Pat. No. 6,077,177, which is a continuation-in-part of application No. 08/986,382, filed on Dec. 8, 1997, now Pat. No. 5,879,247, which is a continuation of application No. 08/799,979, filed on Feb. 12, 1997, now Pat. No. 5,695,417.

(51) Int. Cl.[7] ..... A63B 63/08

(52) U.S. Cl. ..... 473/484; 473/483; 473/482; 248/280.11; 248/283.1

(58) Field of Search ..... 473/481, 482, 473/483, 484; 248/283.1, 404, 280.11

(56) References Cited

U.S. PATENT DOCUMENTS

| | | | |
|---|---|---|---|
| 276,637 | A | 5/1883 | Slater |
| 1,924,811 | A | 8/1933 | Schulz |
| 2,932,511 | A | 4/1960 | Bemis |

(List continued on next page.)

FOREIGN PATENT DOCUMENTS

| | | |
|---|---|---|
| NL | 28616 | 2/1965 |

OTHER PUBLICATIONS

Harvard, "1988 Sporting Goods Catalog," p. 8.
Diversified Products, "DP Fit for Life," 1990 Equipment Catalog, Opelika, Alabama, p. 61.
Bison, "An American Legacy", Bison Recreational Products 1993–94 Catalog.
"Component Play Grounds," Equipment Brochure, Salt Lake City, Utah, p. 6 (date unknown).

(List continued on next page.)

*Primary Examiner*—Raleigh W. Chiu
(74) *Attorney, Agent, or Firm*—Madson & Metcalf

(57) ABSTRACT

A novel constant force adjustment assembly for a basketball goal assembly is disclosed. The basketball goal assembly includes a deformable goal support structure attached at a first end to a support pole. A basketball goal is preferably attached at a second end of the goal support structure. An extension arm is operably connected between the goal support structure and a handle member operable by a user to adjust the height of the basketball goal. The constant force adjustment assembly includes one or more resilient members attached to the deformable goal support structure to counterbalance the weight of the basketball goal. The resilient members maybe attached to a cam fixture rigidly mounted, pivotally attached, or otherwise connected to the deformable goal support structure. The cam fixture varies the moment arm of the restorative force of each resilient member so that as the restorative force of the resilient member increases, the length of the moment arm of that force decreases. In one presently preferred embodiment, two resilient members are provided: a gas spring, and a spring member containing a coil spring. In one alternative embodiment of the invention, the cam fixture is pivotally attached to the deformable goal support structure, and operates as part of a linkage to control the orientation of the cam fixture.

36 Claims, 4 Drawing Sheets

U.S. PATENT DOCUMENTS

| | | | | |
|---|---|---|---|---|
| 3,427,025 | A | | 2/1969 | Procter |
| 3,586,324 | A | | 6/1971 | Bearson |
| 3,765,676 | A | | 10/1973 | Bearson et al. |
| 3,802,702 | A | | 4/1974 | Pulley |
| 4,395,040 | A | | 7/1983 | White |
| 4,438,923 | A | | 3/1984 | Engle et al. |
| 4,441,709 | A | | 4/1984 | Schroeder et al. |
| 4,465,277 | A | | 8/1984 | Dittrich |
| 4,684,129 | A | | 8/1987 | Andersen et al. |
| 4,781,375 | A | | 11/1988 | Nye |
| 4,798,381 | A | | 1/1989 | Dadbeh |
| 4,801,142 | A | | 1/1989 | Friesen |
| 4,805,904 | A | | 2/1989 | Nye |
| 4,846,469 | A | | 7/1989 | Nye |
| 4,881,734 | A | | 11/1989 | Nye |
| 5,133,547 | A | | 7/1992 | Pardi |
| 5,158,281 | A | | 10/1992 | Williams |
| 5,211,393 | A | | 5/1993 | Rolffs et al. |
| 5,259,612 | A | | 11/1993 | Matherne et al. |
| D350,797 | S | | 9/1994 | Curtis |
| 5,388,821 | A | | 2/1995 | Blackburn |
| 5,465,957 | A | | 11/1995 | Schroeder |
| 5,478,068 | A | | 12/1995 | Schroeder |
| 5,503,390 | A | | 4/1996 | Hall |
| 5,573,237 | A | | 11/1996 | Van Nimwegen et al. |
| 5,573,238 | A | | 11/1996 | Aaron et al. |
| 5,601,284 | A | | 2/1997 | Blackwell et al. |
| 5,695,417 | A | | 12/1997 | Winter et al. |
| 5,720,679 | A | | 2/1998 | Schroeder |
| 5,738,601 | A | | 4/1998 | Hughes |
| 5,879,247 | A | | 3/1999 | Winter et al. |
| 6,077,177 | A | | 6/2000 | Winter et al. |
| 6,135,901 | A | | 10/2000 | van Nimwegen |
| 6,142,891 | A | * | 11/2000 | Winter et al. ..... 473/484 |
| 6,155,938 | A | * | 12/2000 | Mower ..... 473/484 |

OTHER PUBLICATIONS

BPI, "BPI Portable Systems", Basketball Products International Catalog (date unknown).

BPI, "At the Heart of the Sport", Basketball Products International Catalog (date unknown).

Diversified Products, "25 Years of Innovation," Opelika, Alabama, p. 69 (date unknown).

Escalade Sports, "Serious Play", 1997 Products Catalog Featuring Harvard, Stiga, and Spalding Products.

Goalrilla Basketball Systems, "A–LIN Series", Product Brochure (date unknown).

HHBS, Inc., "Pro Series", Basketball Systems Brochure (date unknown).

Huffy Sports, "Be A Player", Client assembled folder of fact sheets (date unknown).

Huffy Sports, "Introducing New Huffy Elevator," Informational Brochure, Waukesha, Wisconsin (date unknown).

Huffy Sports, "Basketball's Hottest Products this year," Equipment Catalog, Waukesha, Wisconsin (date unknown).

Huffy Sports, Equipment Catalog, Waukesha, Wisconsin, p. 21 (date unknown).

Huffy Sports, "Our All–Star Lineup," Waukesha, Wisconsin, p. 21 (date unknown).

Huffy Sports, Equipment Assembly Instruction Sheet, Waukesha, Wisconsin (date unknown).

Porter, "All–in–One "Quick Adjust" Kits," Informational Brochure (date unknown).

Rolbak, "The Original Basket Ball Protecto Net" Fact Sheet (date unknown).

Spalding, "Movers Don't Have to be Shakers", Pro System Mobile Brochure (date unknown).

Sport Court, "Slam Systems", Basketball Standards Catalog (date unknown).

Sure Shot, "Your Best Shot", Product Catalog (date unknown).

Ultra Rim Adjustable Basketball Goals, "The Ultimate Goal", Two–Fold Brochure (date unknown).

Wilson, "Adjustable Backstop Support, Backboard and Goal Kit," Informational Brochure, Franklin Park, Illinois (date unknown).

* cited by examiner

CONSTANT FORCE ADJUSTABLE BASKETBALL GOAL ASSEMBLY

RELATED U.S. APPLICATIONS

This is a continuation-in part of application Ser. No. 09/694,620, filed Oct. 23, 2000, and entitled ELECTRO-MECHANICAL COMPRESSION CRANK ADJUSTMENT MECHANISM FOR A BASKETBALL GOAL ASSEMBLY, which is a continuation-in-part of application Ser. No. 09/249,278, filed Feb. 11, 1999, and entitled COMPRESSION CRANK ADJUSTMENT MECHANISM FOR A BASKETBALL GOAL ASSEMBLY, now issued as U.S. Pat. No. 6,135,901, which is a continuation-in-part of application Ser. No. 09/018,231, filed Feb. 3, 1998 and entitled ADJUSTABLE BASKETBALL GOAL SYSTEM, now issued as U.S. Pat. No. 6,077,177, which is a continuation-in-part of application Ser. No. 08/986,382 filed Dec. 8, 1997 and entitled POWER LIFT BASKETBALL ADJUSTMENT SYSTEM, now issued as U.S. Pat. No. 5,879,247, which is a continuation of application Ser. No. 08/799,979 filed Feb. 12, 1997 and entitled POWER LIFT BASKETBALL ADJUSTMENT SYSTEM, now issued as U.S. Pat. No. 5,695,417. The foregoing applications are incorporated herein by reference.

BACKGROUND OF THE INVENTION

1. The Field of the Invention

The present invention is related to an apparatus for adjusting the height of a basketball goal and, more particularly, to a constant force adjustment assembly for a basketball goal assembly having an extension arm adjustable between a plurality of positions to facilitate the adjustment of the basketball goal over a playing surface.

2. Technical Background

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, is not surprising that more and more people have a basketball goal assembly mounted on their own property.

The problem with many basketball goal assemblies of the prior art is that the goal is usually fixed at a certain height above the playing surface, with a standard height being about ten (10) feet. Children and younger teens, however, generally don't have the strength or agility to shoot and make a basket at the typical height of ten feet. Moreover, children tend to develop improper shooting skills by attempting to throw a basketball toward a goal that is disposed too high. Oftentimes, children or younger teens get frustrated with the sport of basketball and may give up the sport altogether.

Many attempts have been made by those skilled in the art to design basketball goal assemblies which are adjustable to several different heights. Adjustable basketball goal assemblies allow persons of all ages and sizes to enjoy the sport of basketball because the basketball goal can be adjusted to various heights above the playing surface. Some prior art basketball goal assemblies employ a deformable linkage design which generally connects the backboard to a rigid mount such as a support pole. In operation, prior art deformable linkages may be selectively locked at various positions to secure the basketball goal at a predetermined height above the playing surface.

One disadvantage of prior art deformable linkage devices is that the adjustment assembly is typically positioned within or near the linkage which is generally well above the playing surface. Accordingly, whenever a user desires to adjust the height of the basketball goal, the use of a ladder, stool or the like is required to enable the user to reach the adjustment assembly and "unlock" the basketball goal. Having to use a ladder, stool or the like to adjust the height of the basketball goal creates an inherent danger to the user of the potential for falling.

Other prior art adjustable basketball goal assemblies were developed having an adjustment assembly that is only accessible with the use of a separate rod or pole, such as a broomstick handle. Often times, there is not such an adjustment device readily available. The user must therefore accommodate the inconvenience of having to find a suitable implement, or simply choose not to adjust the height of the basketball goal.

Another disadvantage of many prior art adjustable basketball goal assemblies is that the mechanism for adjusting the height of the basketball goal is separate and distinct from the mechanism used to secure the goal assembly at a particular height. Thus, both hands of a user are normally needed to simultaneously unlock the adjustment mechanism, adjust the basketball goal and then lock the adjustment assembly at a predetermined position.

Some prior art basketball goal assemblies are configured with the adjustment assembly positioned adjacent the basketball playing area. Such adjustment assemblies can interfere with users, thereby creating a potentially dangerous situation. For example, such adjustable basketball goal assemblies are usually subject to inadvertent adjustment if bumped by a user or hit with a basketball.

Yet another disadvantage of prior art basketball goal assemblies is that the adjustment assembly is in tension with the linkage device attached to the goal; thus the locking or adjustment assembly is susceptible to separation upon failure and, accordingly, the goal assembly may drop into the playing area and cause potential injuries to users. Another disadvantage of prior art basketball goal adjustment assemblies is that many of the securing and adjustment assemblies require numerous working components and a complex design configuration to be able to simultaneously adjust and secure the basketball goal assembly in a predetermined position above a playing surface. This increases the cost, the difficulty of manufacture and the time required for a user to assemble the basketball goal.

Moreover, many prior art adjustable goal systems require a user to apply considerable force to operate them. Some mechanism is needed to provide an upward force, or counterbalancing force, on the basketball goal to counteract its weight. Several known adjustable systems have a counterweight positioned to rise when the goal falls, and vice versa, to provide a neutral balance, thereby making adjustment easier. However, this approach requires either the use of long, protruding members to provide a longer moment arm for the counterweight, or heavy weights to compensate for a shorter moment arm. Either solution is undesirable. Long counterweight extensions impede goal placement and possibly game play. Heavy weights make the entire assembly expensive to ship and difficult to move.

Springs, when used in the place of a counterweight, are prone to a different problem. Since the force provided by a spring increases with the spring's deflection, the counterbalancing force increases along the goal's range of adjustment. As a result, the counterbalancing force will be inadequate when the spring is nearly undeflected, i.e., when the goal is near the top of its range of adjustment, so that a user must bear a portion of the goal's weight to adjust it. Similarly, when the goal is in a lower position, the counterbalancing force is too great, so that a user must fight the counterbalance to avoid adjusting the goal height more than desired. The unpredictability of such a mechanism is frustrating for users, who may have to make several adjustments to obtain a desired goal height.

Furthermore, many known adjustment assemblies are difficult to fine-tune because they are either locked in place, or unlocked for adjustment. Once unlocked, the goal adjustment assembly moves freely, so that it is difficult to make slight adjustments, especially if the counterbalancing force is too large, too small, or not present. Such free motion also creates a danger of injury from rapid adjustment. For example, a person standing underneath the goal may be injured if another person unlocks the adjustment mechanism, thereby allowing the backboard to fall rapidly.

Another disadvantage of many known adjustment assemblies is that they obstruct the space behind the backboard with springs, levers, and the like. As a result, an overshot ball may become lodged behind the backboard by the adjustment mechanism, or possibly trip or damage the adjustment mechanism. If the backboard is transparent, visible componentry of the adjustment assembly may distract players, especially if it shows through the square typically painted on backboards to help players aim at the basket.

From the foregoing, it will be appreciated that it would be an advancement in the art to provide an adjustable basketball goal assembly that can be adjusted without the use of a ladder or a pole. It would be a further advancement to provide such an adjustable basketball goal assembly that could be quickly and easily adjusted using a single hand of a user. It would be yet another advancement to provide an adjustable basketball goal assembly that does not interfere with game play and that would not endanger users if the adjustment or locking mechanism failed. Moreover, it would be another advancement in the art to provide an adjustable basketball goal assembly that is simple in design and cost effective relative to manufacture.

Furthermore, it would be an advancement in the art to provide an adjustable basketball goal system that is adjustable across a large range of goal heights with a substantially constant input force from a user. It would be a further advancement in the art to provide an adjustable basketball goal system with dampened motion, such that adjustment takes place in a measured, safe fashion. Yet further, it would be an advancement in the art to provide an adjustable basketball goal system in which components of the adjustment assembly are substantially removed from the area behind the backboard, so that overshot basketballs will not strike the adjustment mechanism, and players will not be distracted by additional parts behind a transparent backboard.

Such an adjustable basketball goal assembly is disclosed and claimed herein.

BRIEF SUMMARY OF THE INVENTION

The present invention is directed to a novel adjustable basketball goal assembly having a constant force adjustment assembly that facilitates adjusting the height of a basketball goal above a playing surface. The basketball goal assembly of the present invention includes a support pole that extends in a substantially upward direction. The support pole has a goal side and a back side formed opposite the goal side. A deformable goal support structure may be pivotally attached to the goal side of the support pole such that the goal support structure is suspended above the playing surface. The goal support structure includes an upper support arm and a lower support arm. In one presently preferred embodiment of the present invention, one of the support arms has a tail section that extends substantially outward from the back side of the support pole.

A basketball goal is preferably attached to the goal support structure adjacent the goal side of the support pole. In one presently preferred embodiment, the goal comprises a rim, a backboard and a net. The goal support structure is preferably configured such that as the goal support structure deforms, the height of the basketball goal above the playing surface is correspondingly adjusted, wherein each variation in height of the basketball goal corresponds to a different deformation of the goal support structure. In operation, the goal support structure allows the rim of the basketball goal to be adjusted to several different heights while retaining the rim in a substantially horizontal disposition in relation to the playing surface.

In one presently preferred embodiment, a handle member is pivotally mounted at the back side of the support pole such that a user can adjust the handle member without needing a ladder, stool, pole or the like. An extension arm is preferably positioned between the parallelogrammic deformable goal support structure and the handle substantially along the back side of the support pole. A first end of the extension arm is pivotally attached to a cam fixture mounted on the tail section of the lower support arm and a second end of the extension arm is pivotally attached to the handle member. The handle member may include a distal end pivotally attached to the support pole and an intermediate portion pivotally attached contiguous a second end of the extension arm. In this configuration, an adjustment of the handle member moves the extension arm and deforms the parallelogrammic structure to thereby adjust the height of the basketball goal in relation to the playing surface. Thus, the height of the basketball goal can be adjusted without the use of a ladder or other adjustment implement.

In preferred design, a first resilient member, in the form of a gas spring, also pivotally engages the intermediate portion of the handle member and the support pole. The gas spring includes a first adjustment member telescopically engaged within a second adjustment member. One or more internal compressible fluids, such as a gas and an oil, operate to urge the first adjustment member out from the second adjustment member, thereby pressing the handle downward to oppose the weight of the basketball goal.

The gas spring has an internal valve structure operable by means of a rod extending through the first adjustment member. The rod actuates the internal valving to lock the gas spring against adjustment when the rod is drawn outward from the first adjustment member, and to permit adjustment when the rod is pressed into the first adjustment member. The rod is pivotally attached to a trigger, which is, in turn, pivotally attached to the handle member. The trigger acts as a lever, such that a user squeezing the trigger against the handle pushes the rod into the first adjustment member, thereby permitting adjustment of the gas spring. Once adjustment of the basketball goal assembly is completed, a user releases the trigger and the handle, and the rod is drawn from the first adjustment member to once again lock the gas spring. Hence, and the entire basketball goal assembly is locked in that configuration until the user once again grips the handle and squeezes the trigger.

When released, the gas spring, like a coil spring, provides a force proportional to its deflection. Thus, when the basketball goal is near its lowest point, the gas spring is greatly compressed and provides a large restorative force. When the basketball goal is near its highest point, the gas spring is only slightly compressed, so the restorative force is less. This changing force is compensated for by the cam fixture mounted on the tail section of the lower support arm.

The cam fixture provides an offset for the force of the gas spring, which acts on the goal support structure through the extension arm. The attachment point of the extension arm on the cam fixture is effectively drawn inward, toward the support pole, as the goal moves downward. This lessens the moment arm of the gas spring's force on the lower support arm. The smaller moment arm compensates for the larger force of the gas spring when it is greatly compressed, as when the goal is lowered. Consequently, the moment exerted by the gas spring on the goal support structure, and therefore the upward force provided to counterbalance the weight of the basketball goal, remains substantially constant through the basketball goal's entire range of adjustment.

The gas spring also tends to resist rapid adjustment. The internal fluids of the gas spring create an additional force that is opposed to and proportional to the velocity of adjustment in either direction. This may be called a dampening force because it tends to dampen rapid motion. Thus, the basketball goal assembly will only be adjustable at a relatively safe rate of speed, or rate of adjustment, even if a user is pushing or pulling the handle with considerable force.

In one presently preferred embodiment, a second resilient member is also provided. The second resilient member may include a second adjustment member telescopically engaged within a first adjustment member. However, a coil spring inside the first and second adjustment members may be used to provide the restorative force for the second resilient member. The second resilient member may be pivotally attached to the support pole and to the cam fixture, so that it functions similar to the first resilient member. More specifically, as the basketball goal is lowered, the spring stretches to a greater deflection, thereby providing a larger restorative force. The cam offset decreases the moment arm of this force against the goal support structure as the basketball goal is lowered, thereby providing a constant counterbalancing force against the basketball goal, substantially independent of the goal's height above the playing surface.

The basketball goal assembly may also include a support base configured having an internal cavity sufficient for receiving and retaining a ballast material. The support base is configured such that when filled with a ballast material, the base stabilizes the adjustable basketball goal assembly and supports the support pole, disposed in a receiving aperture formed in the support base, in a substantially upright position.

Thus, it is an advantage of the present invention to provide an adjustable basketball goal assembly with an adjustment assembly in compression with the extension arm and which does not interfere with the playing area. It is another advantage of the present invention to be able to adjust the height of the basketball goal without the aid of a ladder or pole. It is a further advantage of the present invention to be able to easily adjust the height of the basketball goal using only a single hand of a user.

It is another advantage of the present invention to be able to adjust the height of the basketball goal by applying a constant external force, independent of the configuration of the basketball goal assembly. It is yet another advantage of the present invention to be able to safely and accurately adjust the height of the basketball goal through a dampening force provided by the adjustment mechanism. It is an additional advantage of the present invention to be able to adjust the height of the basketball goal without interference with game play from adjustment assembly components behind the backboard. Still further, it is an advantage of the present invention to provide an adjustable basketball goal assembly that is cost effective to manufacture and easy to assemble.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 2:
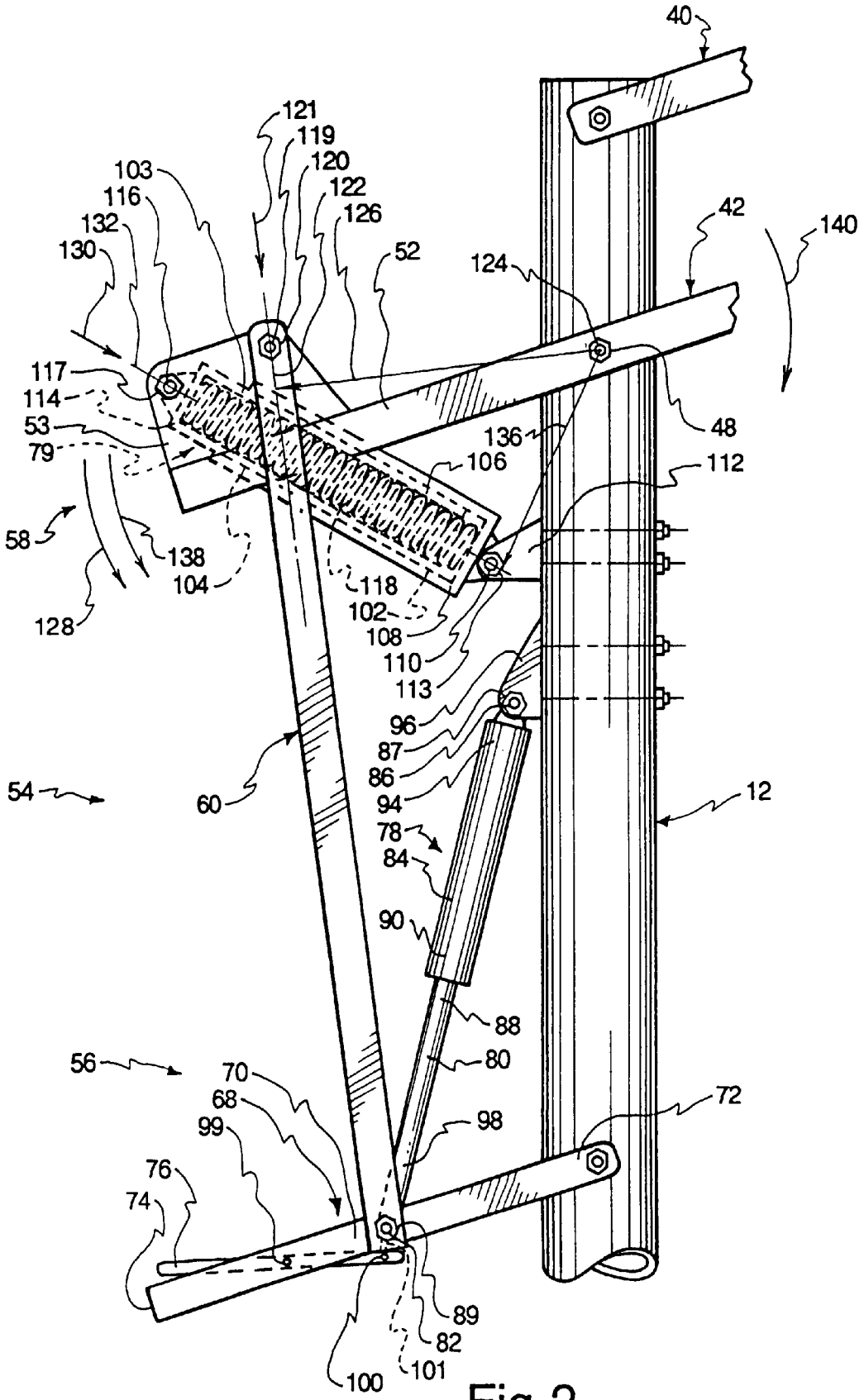
FIG. 2 is a side plan view of the constant force adjustment assembly of the basketball goal assembly of FIG. 1 with the basketball goal upraised.
Figure 3:
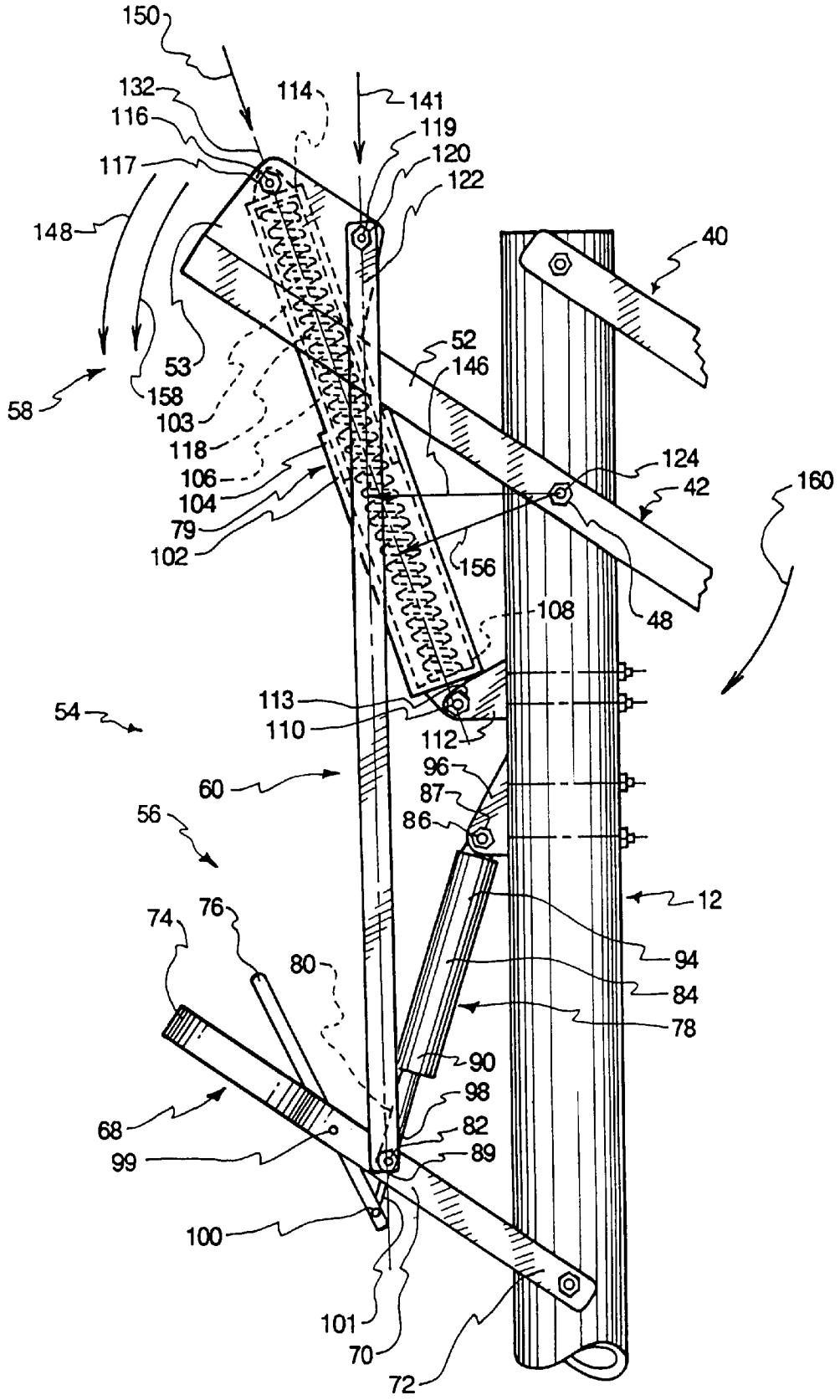
FIG. 3 is a side plan view of the constant force adjustment assembly of the basketball goal assembly of FIG. 1 with the basketball goal lowered.

It will be readily understood that the components of the present invention, as generally described and illustrated in the Figures herein, could be arranged and designed in a wide variety of different configurations. Thus, the following more detailed description of the embodiments of the assembly and method of the present invention, as represented in FIGS. 1 through 3, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
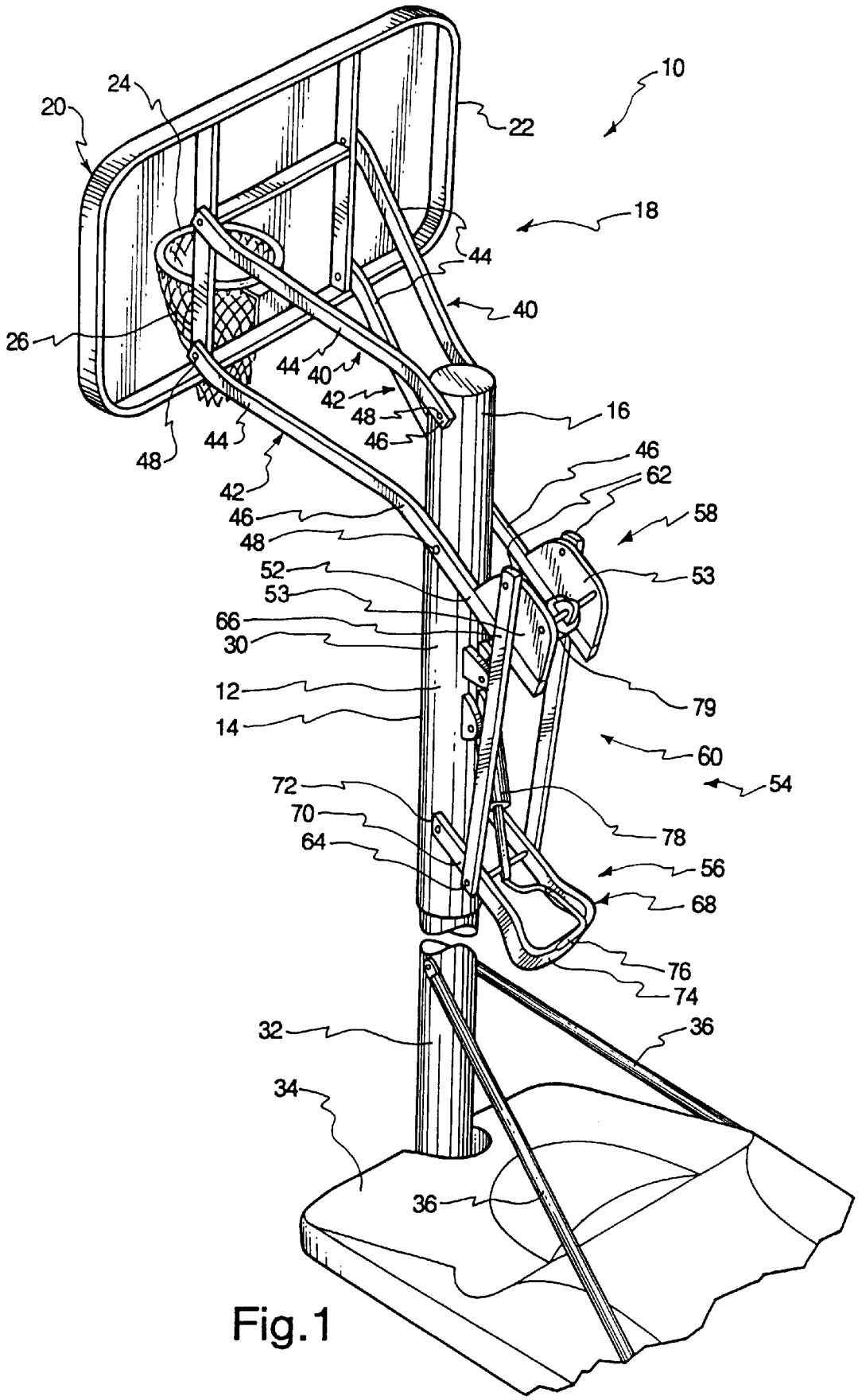
FIG. 1 is a perspective view of one presently preferred embodiment of a constant force adjustment assembly for a basketball goal assembly of the present invention.

With reference now to FIG. 1, one presently preferred embodiment of the constant force adjustment assembly of the basketball goal assembly according to the present invention is generally designated at 10. As shown, the basketball goal assembly 10 includes a support pole 12 having a goal side 14 and a back side 16 disposed opposite the goal side. The support pole 12 generally extends in a substantially upward direction when the basketball goal assembly 10 is disposed in the playing position. As depicted, the support pole 12 has a generally circular, hollow cross section extending in a straight, vertical line. However, embodiments in which the support pole 12 is not straight or has a non-circular or irregular cross-sectional shape are contemplated within the invention.

A goal support structure 18 is connected to the support pole 12 adjacent to the goal side 14 of the support pole 12 above the playing surface. A basketball goal 20 including a back board 22, a rim 24 and a net 26 may be attached to the goal support structure 18 opposite the support pole 12. The goal support structure 18 is generally parallelogrammic and may be deformable into a plurality of configurations wherein at each configuration the basketball goal 20 is disposed at a different height above the playing surface.

In one presently preferred embodiment, the support pole 12 includes an upper pole section 30, to which the goal support structure 18 is attached, and a lower pole section 32 introduceable (e.g., press fit) into the upper pole section 30. This configuration allows for easier assembly of the adjustable basketball goal assembly 10 and is more cost effective to package.

As shown, the lower pole section 32 may be attached to a portable support base 34 having an internal cavity for introducing and selectively retaining a ballast material. Functionally, the support base 34 supports and stabilizes the support pole 12 and the goal support structure 18 in relation to the playing surface. A pair of rods 36 may be provided to secure the support pole 12 upright with respect to the support base 34. As will be appreciated by those of skill in the art, there are a variety of ways readily known in the art to configure a support base 34 in such a manner to stabilize and secure a support pole 12 in a generally upright position. It will further be appreciated that the teachings of this invention maybe practiced using a permanent mount in place of the support base 34 and thereby secure the support pole 12 directly to the floor or ground at a specific location.

The goal support structure 18 of the adjustable basketball goal assembly 10 may comprise a pair of upper support arms 40 and lower support arms 42. The upper and lower support arms 40, 42 each have a first end 44 and a second end 46, respectively. In one presently preferred embodiment, the first ends 44 of the upper and lower support arms 40, 42 are pivotally attached to the basketball goal 20 at differing locations. Preferably, the upper and lower support arms 40, 42 are each pivotally attached to the support pole 12 adjacent the second ends 46 of the upper and lower support arms 40, 42 with a fastener 48 (e.g., bolts, screws, rivets or the like) introduced through corresponding openings (not shown) formed within the upper and lower support arms 40, 42 and the support pole 12. The upper and lower support arms 40, 42 are likewise pivotally attached to the basketball goal 20 by fasteners 48 (e.g., bolts, screws, rivets or the like) positioned through aligned openings (not shown). As will be appreciated, there are a variety of other suitable fixation members or methods readily known in the art to pivotally attach the basketball goal to the support pole 12.

As best shown in FIG. 1, the upper supports 40, the lower supports 42, the support pole 12, and the backboard 22 define a goal support structure 18, which is preferably parallelogrammic in configuration. Because the upper supports 40 and the lower supports 42 are pivotally mounted, the parallelogrammic goal support structure 18 can be deformed to adjust the height of the basketball goal 18 above a playing surface while allowing the backboard 22 to remain substantially vertical in disposition and the rim 24 to remain substantially horizontal in relative disposition.

At least one of the support arms 40, 42 includes a tail section 52 adjacent the second end 46 of the support arms 40, 42 which extends substantially outwardly from the back side 16 of the support pole 12. In one presently preferred embodiment, the tail section 52 is an integral part of the lower support arms 42. A cam fixture 53 may be disposed above the tail section 52. A "cam fixture" refers to any structure configured to provide a constant or variable offset for attaching or registering another member.

The cam fixture 53 may be a separate attachment to the tail section 52, or may be integral with the goal support structure 18. Structurally, the tail section 52, through the cam fixture 53, provides a place to link the goal support structure 18 to an adjustment assembly 54. The adjustment assembly 54 is preferably generally located adjacent the back side 16 of the support pole 12 such that a user can manipulate the adjustment assembly 54 while standing on the ground. The adjustment assembly 54 has a first end 56 located comparatively low with reference to the support pole 12, for easy user accessibility, and a second end 58 positioned generally above the first end 56. The first end 56 maybe connected to the support pole 12, and the second end 58 maybe connected to the goal support structure 18, as will be described below.

Consistent with the foregoing structural configuration, the height of the basketball goal 20 may be adjusted without the aid of a separate adjustment device, ladder, stool or the like. Further, with the adjustment assembly 54 located on the back side 16 of the support pole 12, the adjustment assembly 54 is less likely to interfere with basketball play.

Referring now to FIGS. 1 and 2, an extension arm 60 includes at least one bar 62. In one presently preferred embodiment, the extension arm 60 includes a pair of bars 62, each having a first end 64 and a second end 66. The second end 66 of each of the bars 62 may be pivotally attached to the cam fixtures 53 mounted on the respective tail sections 52 of the lower support arms 42. The first end 64 of each of the bars 62 may be disposed for cooperation with a handle member 68.

Preferably, the handle member 68 is connected to the extension arm 60 and configured such that a user may grasp the handle member 68 and provide an input force to change the height of the basketball goal 20. In one presently preferred embodiment, an intermediate portion 70 of the handle member 68 is pivotally connected to the bars 62, and a distal end 72 of the handle member 68 is pivotally connected to the support pole 12. A proximal end 74 of the handle member 68 is shaped as a handle 74 for comfortable gripping. The extension arm 60 is positioned substantially along the back side 16 of the support pole 12 such that movement of the extension arm 60 selectively deforms the goal support structure 18. The extension arm 60 may be pivotally attached to the cam fixtures 53 and the handle 68 by a variety of ways known in the art, including bolts, screws, rivets, cotter pins or the like.

The purpose of the adjustment assembly 54 is to facilitate reconfiguration of the high goal support structure 18 from a low user's location. Thus, the adjustment assembly 54, as depicted in the embodiment of FIG. 1, includes the bars 62 of the extension arm 60, the handle member 68, and the cam fixture 53. The operation of the extension arm 60 and the handle 68 enables a user to reconfigure the goal support structure 18 from a convenient location, i.e., the first end 56 of the adjustment assembly 54. A user therefore need not reach the second end 58 of the adjustment assembly 54, or the portion of the goal support structure 18 to which the second end 58 is attached in order to adjust the height of the goal 20.

The adjustment assembly 54 need not be as shown, but may have any configuration suitable for conveying an input force from a user upward to the goal support structure 18.

The adjustment assembly 54 may, for example, have a handle or other graspable member configured to slide vertically along the support pole 12, in place of the pivotal attachment depicted in FIG. 1. The adjustment assembly 54 need not be entirely rigid, but may comprise cables, bendable links, or other flexible members.

Similarly, the goal support structure 18 need not be parallelogrammic, as depicted in FIG. 1. The goal support structure 18 may have other forms of pivotal attachment, such as a non-parallelogrammic four bar, four pivot linkage system. Alternatively, the goal support structure 18 may comprise one or more sliding members. For example, the goal support structure 18 may take the form of a rigid member affixed to the goal 20, with rollers, bushings, bearings, a smoothed surface, or some other feature configured to permit the goal support structure 18 to slide vertically along the support pole 12. As with the adjustment assembly 54, the goal support structure 18 need not be entirely rigid, but may include flexible components.

The handle member 68 may also have a trigger 76 that a user can press against the handle 74 to free the adjustment assembly 54 for adjustment. The trigger 76 may comprise any structure operable by a user in conjunction with the handle member 68. A first resilient member 78 may be pivotally attached to the support pole 12 and to the intermediate portion 70 of the handle member 68 to provide a counterbalancing force to the weight of the basketball goal 20. A "resilient member" refers to any member capable of storing energy, and providing stored energy in the form of force.

The first resilient member 78 may be configured as a gas spring 78 to provide a method by which the configuration of the basketball goal assembly 10 may be locked in place after adjustment, and to dampen adjustment of the basketball goal assembly 10. A second resilient member 79 may also be used to provide additional counterbalancing force. The second resilient member 79 may take the form of a spring member 79 pivotally attached to the support pole 12 and the cam fixture 53. Those of skill in the art will recognize that the resilient members 78, 79 need not be as depicted, but may, for example, comprise linear springs, torsional springs, leaf springs, other elastically bendable members, compressible solid, semisolid, or fluidic substances, or any combination thereof.

As best shown in FIG. 2, the gas spring 78 includes a first adjustment member 80 pivotally connected to the extension arm 60 and the handle member 68 at a first point of attachment 82. The gas spring 78 also includes a second adjustment member 84 pivotally connected to the support pole 12 at a second point of attachment 86. A first end 88 of the first adjustment member 80 is configured to cooperate with a first end 90 of the second adjustment member 84 to thereby permit selective movement of the first adjustment member 80 relative to the second adjustment member 84. In the configuration shown in FIG. 2, in which the basketball goal 20 is upraised, the gas spring 78 is substantially uncompressed.

In one presently preferred embodiment, the gas spring 78 is positioned relative to the support pole 12 and extension arm 60 such that the second point of attachment 86 is disposed above the first point of attachment 82. One of skill in the art will appreciate that in this configuration, the force due to gravity acting on the basketball goal 20 and transferred to the extension arm 60 will cause the first adjustment member 80 and the second adjustment member 84 to be in compression relative to each other.

In one presently preferred embodiment, the second adjustment member 84 is attached at a second end 94 to the support pole 12 by means of a pivotal attachment mechanism 96, which may be embodied as a bracket 96, secured to the back side 16 of the support pole 12. For example, a bolt 87 may be positioned within aligned openings within the second end 94 of the second adjustment member 84 and within the bracket 96 to secure the second adjustment member 84 to the support pole 12. A fastener 89 may also be positioned within holes (not shown) in the intermediate portion 70 of the handle member 68, such that a second end 98 of the gas spring 78, extension arm 60, and handle member 68 are all connected at the first point of attachment 82. It will be readily appreciated by those skilled in the art that the gas spring 78 may be positioned in a variety of ways relative to the extension arm 60 and the support pole 12 to allow the gas spring 78 to remain in compression, rather than in tension along the back side 16 of the support pole 12.

The gas spring 78 contains one or more internal fluids (not shown) that provides the restorative force of the gas spring. The gas spring 78 also contains internal structures (not shown), such as valves, that make the gas spring 78 lockable at any desired position. The trigger 76 is pivotally attached to the handle member 68 at an attachment point 99. Another attachment point 100 on the trigger 76 provides pivotal engagement with a rod 101 extending into the gas spring 78 through a coaxial bore (not shown) in the first adjustment member 80. When the trigger 76 is rotated into near-alignment with the handle member 68, as shown in FIG. 2, the rod 101 is pressed into the first adjustment member 80 to unlock the gas spring 78 for adjustment. A user may then raise the handle 74 of the handle member 68 to simultaneously compress the gas spring 78 and urge the extension arm 60 upward, or obtain the opposite result by lowering the handle 74.

The operation of the gas spring 78 provides for damping of the adjustment assembly 54. Damping refers to a force that acts against motion, with a magnitude proportional to the velocity of that motion. The internal fluid of the gas spring 78 induces damping of the gas spring 78 as the fluid moves through constricted spaces within the gas spring 78. This limits the speed with which adjustment of the gas spring 78 may be accomplished. Thus, when the gas spring 78 is unlocked, the basketball goal 20 is not permitted to swing rapidly upward or downward. Fine tuning of the position of the basketball goal 20 is therefore more easily done, and players will not be injured by rapidly moving members during adjustment.

The second resilient member 79, or spring member 79, may be positioned above the gas spring 78, and at the back side 16 of the support pole 12. The spring member 79 may have a first adjustment member 102, which telescopically engages a second adjustment member 103, similar to the adjustment members 80, 84 of the gas spring 78. Thus, a first end 104 of the first adjustment member 102 engages a first end 106 of the second adjustment member 103. In the configuration of FIG. 2, the spring member 79 is compressed, so that the first end 106 of the second adjustment member 103 is contained within the first adjustment member 102.

A second end 108 of the first adjustment member 102 is pivotally attached to the support pole 12 at a first point of attachment 110. The first point of attachment 110 may be fixed by a pivotal attachment mechanism 112, or bracket 112, affixed to the back side 16 of the support pole 12. For example, a fastener 113, which may be of any suitable type, may be threaded through concentric holes (not shown) in the bracket 112 and through similar holes (not shown) in the second end 108 of the first adjustment member 102. Similarly, a second end 114 of the second adjustment member 103 maybe attached to the cam fixture 53 at a second point of attachment 116. Attachment maybe accomplished by threading a fastener 117 of any suitable type through aligned holes (not shown) in the second end 114 and the cam fixture 53.

The spring member 79 preferably has a coil spring 118 contained within the first and second adjustment members 102, 103 to provide restorative force. The coil spring 118 is attached to the second ends 108 and 114 of the adjustment members 102 and 103, respectively. The coil spring 118 is in tension throughout the entire range of motion of the adjustment assembly 54. Thus, the coil spring 118 provides a restorative force tending to draw the cam fixture 53 downward and toward the support pole 12. This force increases as the spring member 79 lengthens, or as the basketball goal 20 lowers. Since the coil spring 118 is not in compression, no buckling of the coil spring 118 is possible. Hence, the first and second adjustment members 102, 103 are needed mainly to avoid the possibility of pinching a body part of a user as the coil spring 118 contracts during adjustment.

The spring member 79 acts to provide a restorative force in addition to that provided by the gas spring 78. This enables a smaller, lighter gas spring 78 to be used. In addition, the spring member 78 maybe more easily adjusted or replaced to accommodate different-sized basketball goals 20. The length of the coil spring 118 may also be altered to raise or lower the restorative force of the spring member 79 across the full range of adjustment of the adjustment assembly 54.

The forces exerted on the goal support structure 18 by the gas spring 78 and spring member 79 act through the cam fixture 53 to provide the unique constant force characteristics of the present invention. The term "constant moment" may be more appropriate, because it is the pivotal motion of the goal support structure 18 that is to be balanced. However, over the range of motion of the goal support structure 18, the term "constant force" is a suitable approximation. The upward or downward force a user must apply against the handle 74 to rotate the handle member 68, thereby adjusting the height of the basketball goal 20 at a constant rate, is substantially constant over the range of motion of the basketball goal 20. This is what is meant by "constant force."

A substantially constant force need not be precisely constant, but is simply such as a typical user could apply against the handle 74 without perceiving that the handle 74 becomes significantly easier or more difficult to lift or lower over the range of motion of the handle 74. The constant force and constant moment concepts, and how they are embodied in the present invention, will be further clarified by the following discussion.

The extension arm 60 is attached to the cam fixture 53 at a point of attachment 119, which may be secured by a fastener 120 similar to the fasteners 87, 89, 113, and 117 through aligned holes in the extension arm 60 and the cam fixture 53. The restorative force of the gas spring 78 acts through the extension arm 78 to draw the cam fixture 53 downward, thereby rotating the lower support arms 42. This restorative force is represented by the arrow 121, which is parallel to the extension arm 60. The line 122 depicts the axis 122 along which the force 121 acts. A line perpendicular to the axis 122 and extending from the axis 122 to a pivot point 124 of the lower support arms 42 is the moment arm 126 of the force 121.

The moment 128, or turning force, induced in the lower arms 42 by the force 121 is obtained from the following equation: Moment=Force×Moment Arm. In the configuration of FIG. 2, the gas spring 78 is only slightly compressed, so the force 121 is small. However, the moment arm 126 is long, so the resulting moment 128 acting on the lower support arms 42 is of intermediate magnitude.

Similarly, the spring member 79 is attached to the cam fixture 53, and acts on the cam fixture 53 with a force designated by the arrow 130, acting along an axis 132. The resultant moment arm 136, as with the moment arm 126, is the line perpendicular from the axis 132, and extending from the axis 132 to the pivot point 124. As with the gas spring 78, the moment arm 136 of the spring member 79 is comparatively long, while the magnitude of the force 130 is small, so that the moment 138 induced on the lower support arms 42 by the spring member 79 is intermediate in the upraised configuration of FIG. 2.

The moments 128 and 138 both act to turn the lower support arms 42 in a counterclockwise direction, with reference to the view of FIG. 2. The moments 128, 138 thus combine to counterbalance the moment 140 induced in the lower support arms 42 by the weight of the basketball goal 20. The combined moments 128 and 138 may be seen as providing an upward force on the basketball goal 20 because the moments 128 and 138 act through the goal support structure 18 to raise the basketball goal 20. Viewed in this way, the upward force provided by the combined moments 128, 138 is preferably of substantially the same magnitude as the weight of the basketball goal 20, across the entire range of adjustment of the basketball goal assembly 10.

Referring to FIG. 3, The trigger 76 is shown in the uncompressed (locked) configuration, and the upper and lower support arms 40 and 42 are directed downward to maintain the basketball goal 20 at a lower position. The trigger 76 may be biased away from the handle 74 by a spring (not shown), or by operation of the internal structures of the gas spring 78. Thus, releasing the trigger 76 may cause it to return to the uncompressed state of FIG. 3. This draws the rod 101 outward from the first adjustment member 80, thereby locking the gas spring 78 against further adjustment.

With the basketball goal 20 lowered, the gas spring 78 is substantially compressed, so that the first end 88 (not shown in FIG. 3) of the first adjustment member 80 is substantially contained within the second adjustment member 84. Likewise, the spring member 78 is substantially uncompressed, so that the second end 106 of the second adjustment member 103 is substantially exposed, but still engaged by the first end 104 of the first adjustment member 102.

Consequently, both the gas spring 78 and the spring member 79 provide greater restorative force than in the configuration of FIG. 2. However, the use of the cam fixture 53 helps compensate for that increase in restorative force. As depicted in FIG. 3, the force 141 exerted by the gas spring 79 on the lower support arms 42 still acts along the axis 122 parallel to the extension arm 60. However, since the cam fixture 53 maintains the point of attachment 119 of the extension arm 60 in an offset position from the lower support arms 42, the point of attachment 119, and hence the axis 122, are now nearer the pivot point 124 than in the configuration of FIG. 2. The moment arm 146 for the gas spring 78 is therefore shorter than the corresponding moment arm 126 of FIG. 2. Thus, a larger force 141 is now multiplied by a smaller moment arm 146 to obtain a moment 148 of intermediate magnitude acting on the lower support arms 42.

Similarly, the point of attachment 116 of the spring member 79 is offset from the lower support arms 42. The stretched state of the coil spring 118 in FIG. 3 causes the force 150 of the spring member 79 against the lower support arms 42 to be larger. As in FIG. 2, the force 150 acts along the axis 132 parallel to the spring member 79. Due to the offset mounting of the point of attachment 116, the moment arm 156 of the force 150 is comparatively small. The larger force 150 multiplied by the smaller moment arm 156 yields a moment 158 of intermediate magnitude acting on the lower support arms 42.

As in FIG. 2, the moments 148 and 158 of the gas spring 78 and the spring member 79 combine to balance the moment 160 induced in the lower arms 42 by the basketball goal 20. Since the moment 160 when the basketball goal 20 is lowered is nearly the same as the moment 140 when the basketball goal 20 is raised, the sum of the moments 128, 138 is preferably nearly equal to the sum of the moments 148, 158. It is anticipated that some change in the moment induced by the weight of the basketball goal 20 will occur across the range of adjustment of the basketball goal assembly 10. Preferably, these changes are compensated for changes in the sum of moments induced by the gas spring 78 and the spring member 79. In other words, the gas spring 78 and the spring member 79 preferably provide an accurate counterbalance for the weight of the basketball goal 20 for all positions of the basketball goal 20.

When this is the case, that is, when the counterbalancing moment is equal to the moment caused by the basketball goal 20 across the entire range of adjustment of the basketball goal 20, constant moment operation has been achieved. The goal support structure 18 then has a substantially neutral balance, so that adjustment efforts encounter neither significant resistance nor acceleration from the goal support structure 18. "Substantially neutral balance" is therefore not perfect balance, but rather balance that is close enough that a user can easily apply sufficient force to arrest reconfiguration of the goal support structure 18. Constant moment operation leads to constant force operation, because a user applying a constant force upward or downward against the handle 74 induces a relatively constant, predictable change in the height of the basketball goal 20.

Nevertheless, some deviations from precise constant force operation are anticipated. These are preferably such as would not hinder adjustment of the height of the basketball goal 20. Such deviations may be reduced by adjusting the geometry of the basketball goal assembly 10 to form alternative embodiments.

Figure 4:
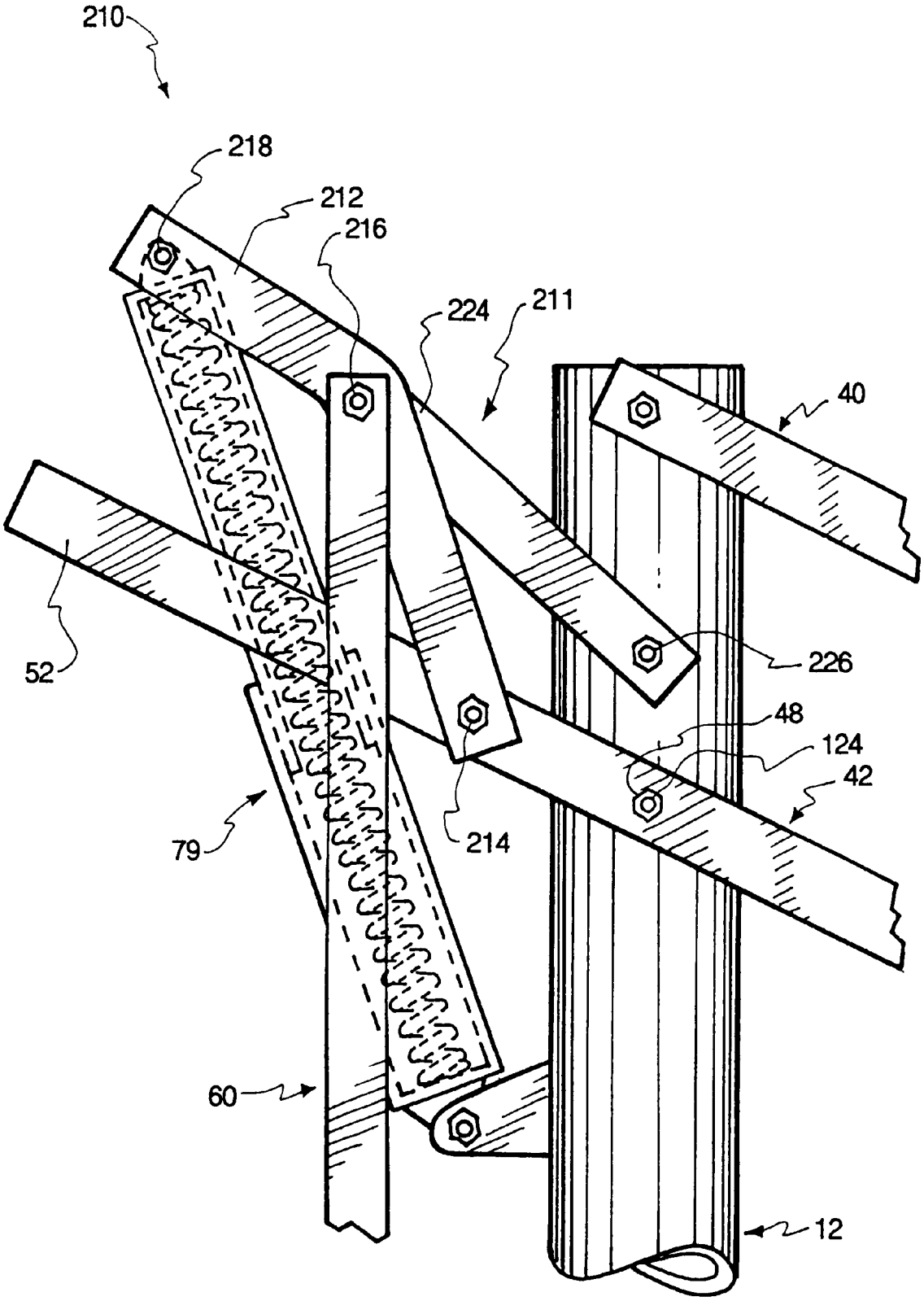
FIG. 4 is a side plan view of an upper portion of an alternative embodiment of a constant force adjustable basketball goal assembly, according to the invention, with a linkage design used to provide constant force adjustment.

Referring to FIG. 4, one such alternative embodiment of basketball goal assembly 210 providing constant force adjustment is used. According to this embodiment, a linkage 211 is used to receive the restorative forces of the gas spring 78 (not shown) and the spring member 79. The linkage 211 operates to fine tune the moment arms with which the restorative forces act upon the lower support arms 42 to counterbalance the weight of the basketball goal 20.

More specifically, a cam fixture 212 maybe pivotally, rather than rigidly, mounted to the tail section 52 at a point of attachment 214. Thus, the cam fixture 212 is permitted to rotate with respect to the lower support arms 42. The cam fixture 212 maintains a point of attachment 216, to which the extension arm 60 is pivotally attached, as in the previous embodiment. Similarly, the spring member 79 may be pivotally attached to the cam fixture 212 at a point of attachment 218.

Rotation of the cam fixture 212 is controlled by operation of the linkage 211. More specifically, a link 224 is also pivotally attached to the cam fixture 212 at the point of attachment 216. The link 224 is pivotally attached to the support pole 12 at a point of attachment 226. Thus, the linkage 211 is of the four-bar, four-pivot type with a single degree of freedom. The basketball goal assembly 210 of FIG. 4 may be adjusted by altering the restorative force of the gas spring 78 or the spring member 79, by changing the lengths of the link 224 or the cam fixture 212, or by changing the locations of the various points of attachment 214, 216, 218, and 226.

Numerous other design features of the present invention may be altered to adapt it for use in a wide variety of settings. For example, when the basketball goal 20 is made heavier, as for professional or tournament play, the first and second resilient members 78, 79 may be scaled accordingly in terms of force output. For example, the first resilient member 78 may comprise a dual gas spring arrangement, with the gas springs arrayed side-by-side to deliver additional counterbalancing force and damping. The second resilient member 79 may likewise comprise dual coil springs mounted side-by-side to increase the counterbalancing force.

The basketball goal assembly of the present invention remedies many of the problems inherent in the prior art. A safe, accessible, and unobtrusive adjustment assembly is provided so that a user may easily adjust the height of the basketball goal.

The adjustment assembly is made easier to use by a cam fixture that evens out the restorative force of elastic members used to counterbalance the weight of the basketball goal. Thus, the adjustment assembly operates roughly in proportion to the input force provided by a user, across the entire range of adjustment of the basketball goal assembly. The damping action of the optional gas spring ensures that rapid, dangerous reconfiguration of the basketball goal assembly is not possible. All of the above is accomplished without adding unnecessary adjustment structures to the area behind the backboard, so that ball motion behind the backboard is unrestricted, and players using a transparent backboard are not distracted.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated in the appended claims rather than by the foregoing description. All changes within the meaning and range of the claims are to be embraced within their scope.

What is claimed and desired to be secured by United States Letters Patent is:

1. A basketball goal assembly allowing for adjustment of the height of a basketball goal above a playing surface, the basketball goal assembly comprising:

a support pole;

a goal support structure supported by the support pole, the goal support structure being deformable into a plurality of configurations wherein at each configuration said basketball goal is disposed at a different height above the playing surface;

an adjustment assembly having a first end connected to the support pole and a second end connected to the goal support structure, the assembly being movable in relation to the support pole and connected to the goal support structure such that movement of the adjustment assembly triggers a corresponding deformation of the goal support structure;

a first resilient member connected to the first end of the adjustment assembly, such that the resilient member urges the adjustment assembly in a direction corresponding to upward motion of the basketball goal in relation to the playing surface; and a second resilient member connected to the second end of the adjustment assembly such that the second resilient member urges the adjustment assembly in a direction corresponding to upward motion of the basketball goal.

2. The basketball goal assembly of claim 1, wherein the goal support structure is pivotally attached to the support pole.

3. The basketball goal assembly of claim 1, wherein the first resilient member is configured to shorten under compression to provide an increasing restorative force as the basketball goal is lowered.

4. The basketball goal assembly of claim 3, wherein the first resilient member comprises a gas spring pivotally attached to the support pole.

5. The basketball goal assembly of claim 3, wherein the adjustment assembly comprises a handle member pivotally attached to the support pole and the gas spring.

6. The basketball goal assembly of claim 1, wherein the second resilient member is configured to lengthen in tension to provide an increasing restorative force as the basketball goal is lowered.

7. The basketball goal assembly of claim 6, wherein the second resilient member comprises a coil spring pivotally attached to the support pole.

8. The basketball goal assembly of claim 1, wherein a moment arm of the second resilient member substantially decreases in length as the basketball goal is lowered, thereby exerting a substantially constant moment on the goal support structure in each of the plurality of configurations of the goal support structure.

9. The basketball goal assembly of claim 8, wherein the second resilient member is pivotally attached to a cam fixture of the adjustment assembly.

10. The basketball goal assembly of claim 1, wherein a moment arm of the first resilient member substantially decreases in length as the basketball goal is lowered, thereby exerting a substantially constant moment on the goal support structure in each of the plurality of configurations of the goal support structure.

11. The basketball goal assembly of claim 10, wherein the moment arm of the first resilient member is influenced by a cam fixture of the adjustment assembly, the cam fixture providing an offset for attachment of the cam fixture proximate the second end of the adjustment assembly.

12. The basketball goal assembly of claim 1, wherein the first resilient member comprises a plurality of parallel gas springs, and the second resilient member comprises a plurality of parallel coil springs.

13. The basketball goal assembly of claim 1, wherein the first and second resilient members are configured to provide an increasing restorative force as the basketball goal is lowered, and wherein each of the first resilient and second resilient members is further positioned with respect to the deformable goal support structure to have a moment arm that substantially shortens the height of the basketball goal decreases.

14. The basketball goal assembly of claim 13, wherein the first resilient member comprises a gas spring pivotally connected to the support pole and a handle member of the adjustment assembly, and wherein the second resilient member comprises a coil spring pivotally connected to the support pole and a cam fixture of the adjustment assembly.

15. The basketball goal assembly of claim 14, wherein the first and second resilient members are configured cooperate to provide a substantially neutral balance in each of the plurality of configurations of the deformable goal support structure.

16. The basketball goal assembly of claim 1, wherein the adjustment assembly comprises a cam fixture pivotally attached to the deformable goal support structure.

17. A basketball goal assembly allowing for adjustment of the height of a basketball goal above a playing surface, the basketball goal assembly comprising:

a support pole;

a goal support structure connected to the support pole, the goal support structure being deformable into a plurality of configurations wherein at each configuration said basketball goal is disposed at a different height above the playing surface;

a cam fixture;

a resilient member connected between the support pole and the cam fixture, the resilient member being configured to cooperate with the goal support structure to exert an upward force on the basketball goal; and wherein the cam fixture is configured such that the upward force acting on the basketball goal retains substantially the same magnitude in each of the plurality of configurations of the goal support structure.

18. The basketball goal assembly of claim 17, wherein the resilient member is pivotally attached to the support pole.

19. The basketball goal assembly of claim 18, further comprising a handle member coupled to the support pole, the handle member being operatively disposed to receive an input force and transmit the input force to the goal support structure to deform the goal support structure.

20. The basketball goal assembly of claim 19, wherein the handle member is pivotally attached to the support pole and an extension arm, the extension arm being pivotally attached to the cam fixture.

21. The basketball goal assembly of claim 20, wherein the resilient member is pivotally attached to the support pole and the handle member.

22. The basketball goal assembly of claim 21, wherein the resilient member is configured to shorten under compression to provide an increasing restorative force as the basketball goal is lowered.

23. The basketball goal assembly of claim 19, wherein the resilient member is further configured to dampen the input force such that a comparatively large magnitude of the input force produces a moderate rate of adjustment of the basketball goal assembly.

24. The basketball goal assembly of claim 23, further comprising a trigger configured to selectively lock and unlock the resilient member against lengthwise expansion such that the goal support structure may be locked in one of the plurality of configurations.

25. The basketball goal assembly of claim 24, wherein the trigger is operably connected to the handle member such that the trigger may be actuated by a hand applying the input force to the handle member.

26. A basketball goal assembly allowing for adjustment of the height of a basketball goal above a playing surface, the basketball goal assembly comprising:

a support pole;

a goal support structure connected to the support pole, the goal support structure being deformable into a plurality of configurations wherein at each configuration said basketball goal is disposed at a different height above the playing surface;

a resilient member pivotally attached between the support pole and the goal support structure, the resilient member being positioned to urge the basketball goal in an upward direction in relation to the playing surface; and wherein a magnitude of an upward force transmitted from the resilient member to the basketball goal is substantially unaffected by deformation of the goal support structure in each of the plurality of configurations.

27. The basketball goal assembly of claim 26, wherein the goal support structure comprises a cam fixture configured to change a length of a moment arm of the resilient member in a substantially inversely proportional relationship to a magnitude of a restorative force exerted by the resilient member.

28. The basketball goal assembly of claim 27, wherein the resilient member is pivotally attached to the support pole and the cam fixture.

29. The basketball goal assembly of claim 28, wherein the resilient member is configured to lengthen under tension to provide an increasing restorative force as the basketball goal is lowered.

30. The basketball goal assembly of claim 26, wherein the resilient member is displaced from the basketball goal to avoid interference with gameplay.

31. The basketball goal assembly of claim 30, wherein the resilient member is positioned on a back side of the support pole.

32. A method of manufacturing a basketball goal assembly, the method comprising:

providing a support pole, a goal, a deformable goal support structure, an adjustment assembly, and a first resilient member;

connecting the deformable goal support structure to the support pole and to the goal so that the goal is supported over a playing surface, wherein a height of the goal over the playing surface is adjustable to a plurality of configurations through deformation of the deformable goal support structure;

connecting a first end of the adjustment assembly to the support pole at a height suitable for actuation by a person;

connecting a second end of the adjustment assembly to the deformable goal support structure such that actuation of the first end causes deformation of the deformable goal support structure; and connecting the resilient member to the support pole and the adjustment assembly such that the deformable goal support structure is substantially neutrally balanced in each of the plurality of configurations.

33. The method of claim 32, wherein connecting the first resilient member to the adjustment assembly comprises connecting the first resilient member to a cam fixture of the adjustment assembly, the cam fixture varying a moment arm about a pivot point of the support pole and the deformable goal support assembly of the first resilient member inversely to a force exerted by the first resilient member against the deformable goal support assembly.

34. The method of claim 32, further comprising providing a trigger connected to the resilient member to lock the resilient member and the deformable goal support structure in one of the plurality of the configurations.

35. The method of claim 32, wherein connecting the resilient member to the adjustment assembly comprises pivotally attaching the resilient member to the first end of the adjustment assembly and to the support pole.

36. The method of claim 35, further comprising pivotally attaching a second resilient member to the support pole and to the second end of the adjustment assembly.

* * * * *

UNITED STATES PATENT AND TRADEMARK OFFICE

CERTIFICATE OF CORRECTION

PATENT NO. : 6,402,644 B2 
DATED : June 11, 2002
INVENTOR(S) : Carl R. Stanford and Charles Monsen It is certified that error appears in the above-identified patent and that said Letters Patent is hereby corrected as shown below:

Title page,
Item [57], ABSTRACT,
Line 12, change "maybe" to -- may be --

Column 1,
Line 42, before "is" insert -- it --

Column 7,
Line 29, change "maybe" to -- may be --

Column 8,
Line 18, change "maybe" to -- may be --

Column 11,
Lines 4, 5 & 28, change "maybe" to -- may be --

Column 12,
Line 35, change "The" to -- the --

Column 16,
Line 6, after "configured" insert -- to --

Column 17,
Line 34, after "pole," delete "."

Signed and Sealed this

Eighteenth Day of February, 2003

JAMES E. ROGAN
*Director of the United States Patent and Trademark Office*